United States Patent [19]

Okamoto et al.

[11] 4,066,929

[45] Jan. 3, 1978

[54] ELECTRON-ACCELERATION TYPE FLATGAS-DISCHARGE PANEL WITH INTERNAL MEMORY FUNCTIONS AND METHOD OF DRIVING FOR SAME

[75] Inventors: Yukio Okamoto; Masashi Mizushima, both of Hachioji, Japan

[73] Assignee: Hitachi, Ltd., Japan

[21] Appl. No.: 652,167

[22] Filed: Jan. 26, 1976

[30] Foreign Application Priority Data

Jan. 24, 1975 Japan ..... 50-9717

[51] Int. Cl.[2] ..... H01J 61/04

[52] U.S. Cl. ..... 315/169 TV; 313/193; 313/217; 340/324 M; 365/116

[58] Field of Search ..... 315/169 TV, 169 R; 313/188, 193, 217; 340/324 M, 173 PL; 358/59, 240

[56] References Cited

U.S. PATENT DOCUMENTS 3,876,906 4/1975 Walters ..... 315/169 TV 3,895,371 7/1975 Kaji et al. ..... 340/324 M 3,934,172 1/1976 Okamoto ..... 315/169 TV

*Primary Examiner*—Eugene R. La Roche

*Attorney, Agent, or Firm*—Craig & Antonelli

[57] ABSTRACT

A flat display panel uses a DC gas-discharge and has flat discharge display elements, which elements have three electrodes composed of a cathode, a grid and an anode and a discharge stabilizing resistor. An auxiliary discharge is formed by using the discharge stabilizing resistor, the cathode and the grid in an auxiliary discharge space defined between the grid and the cathode. A main gas discharge is formed in a main discharge space defined between the anode and the grid by mainly using electrons in a plasma, produced in the auxiliary discharge space, which are diffused and accelerated into the main discharge space. The flat discharge panel, in order to provide a memory function in the main discharge is driven by the use of pulse voltage applied between the anode and the grid.

18 Claims, 29 Drawing Figures

FIG. 3
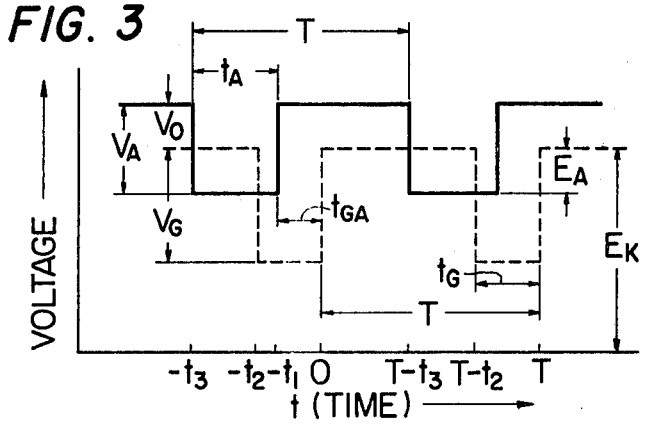
FIG. 4
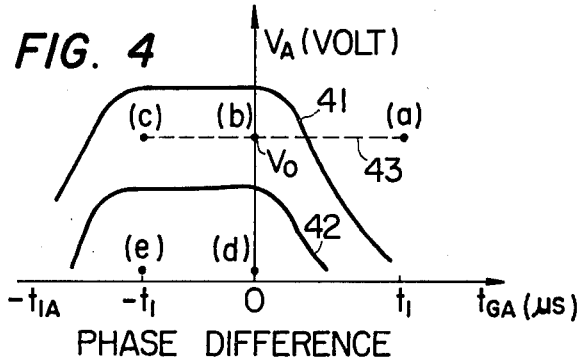
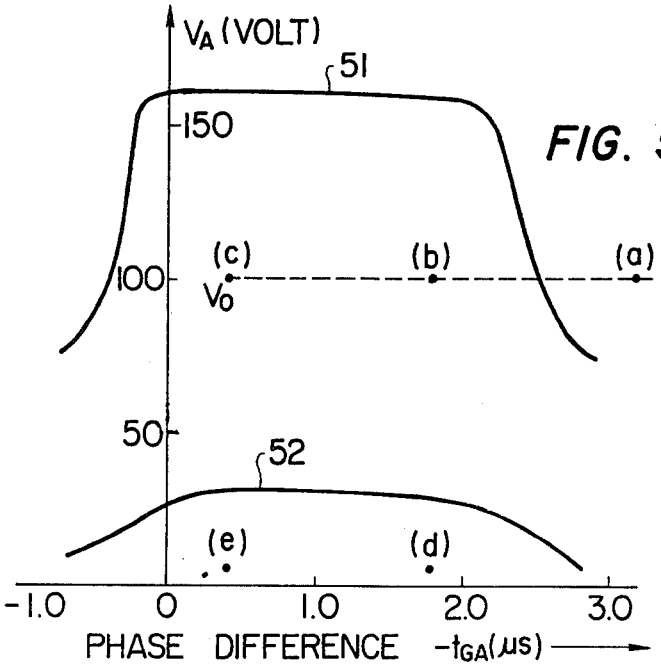
FIG. 5

ELECTRON-ACCELERATION TYPE FLATGAS-DISCHARGE PANEL WITH INTERNAL MEMORY FUNCTIONS AND METHOD OF DRIVING FOR SAME

BACKGROUND OF THE INVENTION

1. Field of the Invention

The present invention relates to a flat display panel for displaying pictures such as characters and figures by utilizing a DC gas-discharge and a method of driving the same and is more particularly directed to the construction of a flat display panel of the electron-acceleration type with an internal memory function and a method of driving such a panel.

2. Description of the Prior Art

Prior-art plain gas-discharge indicator elements, with a gas-discharge tube constituting an element as shown in FIG. 1A consists of a gas-discharge tube 1 which is a discharge cell having an anode A and a cathode K, a resistor R connected to the anode A to control the discharge current, a DC voltage source 2 the positive pole of which is connected to the anode A through the resistor R and a voltage source 3 connected in series with the resistor R and the negative pole is connected to the cathode K through a voltage source 4.

The relationship between the DC discharge voltage V and the luminance B in such a gas discharge cell is shown in FIG. 1B wherein $V_B$ is the breakdown voltage, $V_M$ the discharge maintenance voltage and $V_E$ the discharge extinction voltage. It is apparent from this characteristic curve that a discharge occurs when the DC voltage V of power source 2 is increased to $V_B$ (breakdown voltage), and consequently, the luminance is $B_1$ as shown in FIG. 1B. A discharge, once started, continues even if the applied voltage V is lowered below $V_B$ and it is extinguished only when the applied voltage is lowered to $V_E$(extinction voltage), where the lowest luminance $B_2$ is obtained. That is, there is a potential difference between the discharge breakdown voltage $V_B$ and the extinction voltage $V_E$. Therefore, the applied DC voltage is the maintenance voltage $V_M$, and a bi-stable state is provided; the discharge state is shown by point P' in FIG. 1B and the non-discharge state is shown by point P in FIG. 1B, to constitute a memory function.

For example, the voltage $V_M$ of the power source 2 is determined suitably according to the condition $V_E < V_M < V_B$, and the voltage $V_M/2$ and the voltage $-V_M/2$ are respectively applied to the anode A and the cathode K at all times. Further, if the voltage $(V_B - V_M)/2$ of the voltage source 3 is superimposed on the anode A and the voltage $-(V_B - V_M)/2$ of the voltage source 4 is superimposed on the cathode K the applied potential difference between the anode A and the cathode K is the breakdown voltage $V_B$; therefore the discharge builds-up. On the contrary, the discharge can be extinguished by using a voltage satisfying the condition $-(V_M - V_E)/2$ for the anode A and using a voltage satisfying the condition $(V_M - V_E)/2$ for the cathode K.

Thus, in the conventional display device, the discharge cell 1 has a memory function by using the resistor R connected in series with the anode A to control the discharge current. Also, the flat discharge panel having a memory function is comprised of the discharge display element of the matrix type as shown in FIG. 1C, the discharge display element comprising the resistor R and the discharge cell 1.

However, the conventional discharge panel gives rise to drawbacks as summarized below.

1. The resistor R which is an essential requirement for the gas-discharge display element must have a value at which the tolerances are lower than 10% in order to realize higher reliability, higher luminance and higher stability of the display panel. However, it is very difficult to realize the tolerance with present-day techniques.

2. The time constant $\tau$ determined by the resistance of the resistor R and the capacitance of the stray condenser is too large to enable a quick response, because the resistor R (the resistance of the resistor R is from several hundred kilo ohms to about several mega ohms) is connected to the anode A of the discharge cell 1. Therefore, it is impossible to realize the high speed drive required to display the video signals. For example, in present-day devices, the turn-on time is from about several tens of microseconds to about several hundreds of microseconds in spite of the fact that the required time is lower than 9 microseconds.

3. In order to obtain light for the display in vacuum, ultraviolet radiation is generated by a negative glow function to excite phosphor material. Further, the visible light generated by the gas-discharge is used to obtain high intensity light. This results in a lower luminous efficiency and lower luminance than those of the present invention.

4. As will be seen from the above description, as the discharge cell is driven by the voltage amplitude, the conventional display panel does not realize a high quality picture. Because, the luminance changes according to the each state of the addressed state, the holding state and/or the half-selected state of the discharge cell, that is, each state of the discharge cell depends upon the input voltage.

SUMMARY OF THE INVENTION

It is a principal object of the present invention to provide a flat plasma display panel with an internal memory function which is an improvement over the conventional flat display panel using DC gas-discharge and which provides a high luminance and high efficiency.

It is another object of the present invention to provide a flat plasma display panel having quick response time.

According to the present invention, flat display panel with memory function using DC gas discharge is provided in which the discharge display element is composed of an auxiliary discharge space defined between the cathode electrodes and the grid electrodes, the main discharge spaces defined between the grid electrodes and the anode electrodes, and resistors are connected in series with each cathode electrode, the grid electrode having perforations to control the entrance of electrons generated in the auxiliary discharge space into the main discharge space, and the resistor used to control the auxiliary discharge current.

BRIEF DESCRIPTION OF THE DRAWINGS

FIG. 3 is a diagram showing the waveforms of the voltages which are useful for explaining the method of the driving the flat display panel of the present invention;

FIGS. 4 and 5 are diagrams showing ignition voltage and the extinction voltage characteristics of the main discharge generated Ne gas and Xe gas in the flat display panel of the present invention with a phase difference therebetween;

DETAILED DESCRIPTION

Figure 1A:
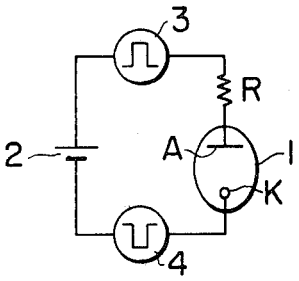
FIG. 1A PRIOR ART
FIG. 1A is a diagram showing the fundamental construction of a gas-discharge cell forming a conventional flat plasma display panel with an internal memory function.
Figure 2:
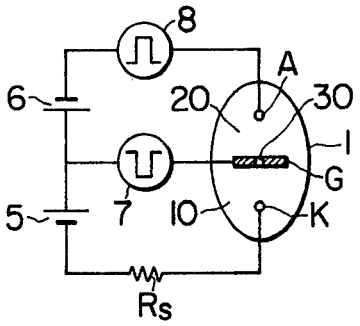
FIG. 2 is a diagram showing the fundamental construction of the gas-discharge cell comprising a flat plasma display panel with an internal memory function of the present invention.

FIG. 2 is a diagram showing the fundamental construction of a gas-discharge cell used to form an electron-acceleration type flat discharge panel with an internal memory function according to this invention. In FIG. 2, the same components as in FIG. 1A are indicated by the same reference numerals. A grid electrode G is arranged between the anode A and the cathode K. $R_S$ indicates a resistor connected between the cathode K and the grid G to control the auxiliary discharge current. A small aperture 30 is located in the grid electrode G. A D.C. voltage source 5 the voltage amplitude of which is $E_K$ is connected from the grid G through the resistor $R_S$ to the cathode K. A D.C. voltage source the voltage amplitude of which is $E_A$ is connected between the anode A and the grid G.

With such a construction, an auxiliary discharge is produced between cathode K and the grid G as a result of applying the voltage $E_K$ between the cathode K and the grid G. The main discharge is produced between the anode A and the Grid G by applying the voltage $E_A$ from the anode A to the grid G. At that time, electrons principally in the plasma produced in the auxiliary discharge space diffuse into the main discharge space. The small apertures 30 serve as paths for electrons which are transmitted from the auxiliary discharge space to the main discharge space.

The driving method of this invention may be explained by the voltage waveform shown in FIG. 3. That is, the grid G and the anode A shown in FIG. 2 are respectively applied with rectangular waveform exciting voltages 1G and 1A with a phase difference $t_{GA}$ which is available from excitation power sources 7 and 8 respectively therebetween as shown in FIG. 3. The rectangular waveform exciting voltage 1A of which the amplitude pulse width and period are respectively $V_A$, $t_A$ and T is indicated by a solid line. The rectangular waveform exciting voltage 1G of which the amplitude, pulse width and period are respectively $V_G$, $t_G$ and T is indicated by a dotted line. The aforesaid main discharge is controlled by a change in the phase difference $t_{GA}$, amplitude $V_A$ and $V_G$ and bias voltage $E_A$ which is applied between the grid G and the anode A as shown in FIG. 3. Thus, it is possible to realize a main discharge with internal memory function between the anode A and the grid G shown in FIG. 2, by controlling the number of electrons, which are produced in the auxiliary discharge space and diffused into the main discharge space through the small apertures 30. Therefore, the present invention differs from the prior art memory function because of the resistor R as shown in FIG. 1A.

According to the flat display panel of the present invention, the electrons passing through the aforesaid apertures function as initial electrons at the breakdown of the main discharge, so that the initial electrons aid in the build-up of the main discharge in its breakdown phase, thereby accelerating the display velocity. For example, the build up time or time lag of the discharge in the breakdown phase of the main discharge, which has a close connection with the display velocity is lower than 1$\mu$S, that is, the build up time or time lag can be reduced to 1/10 or less. The main discharge ignition voltage is about 80 volts, that is, the breakdown voltage can be reduced to $\frac{1}{3}$ or less.

Figure 1B:
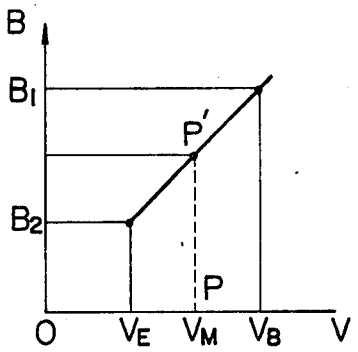
FIG. 1B PRIOR ART
FIG. 1B is a diagram showing the characteristics of the luminance shown in FIG. 1A.
Figure 1C:
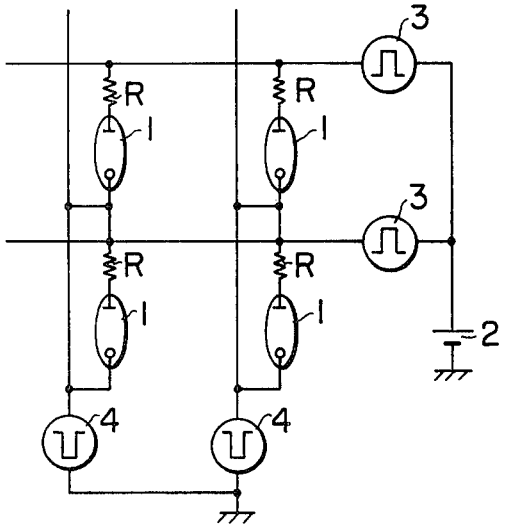
FIG. 1C PRIOR ART
FIG. 1C is a diagram showing a general view of the matrix structure of the conventional panel using the discharge cell.

On the other hand, the electrons which pass through the apertures function as a discharge-sustaining current between the cathode and anode electrodes after the build-up of the main discharge, so that the voltage drop produced by the discharge current at the resistor $R_S$ functions as a current-feedback to the main discharge and as a result, the discharge current is stabilized by the negative feedback. On account of this, the non-uniformity of the amplitude of the discharge current due to the non-uniformity of the value of said resistor $R_S$ is eliminated. Therefore, the tolerance of resistor R shown in FIG. 1 in the case of prior art panels must be $\pm$ 5% whereas the tolerance of resistor $R_S$ (shown in FIG. 2) in the case of the present invention is $\pm$ 20%. Thus, the resistor $R_S$ is easily manufactured.

On the other hand, because of the grid electrode which has small apertures therein electric double layers are created in the grid electrode on the side of the auxiliary discharge spaces, and thus the electric double layers function as a kind of electron lens. The layers converge and accelerate the electrons and further create a positive column discharge in the main discharge space, thereby not only saving power consumption but also providing high efficiency for the flat plasma display panel with internal memory function.

Figure 13A:
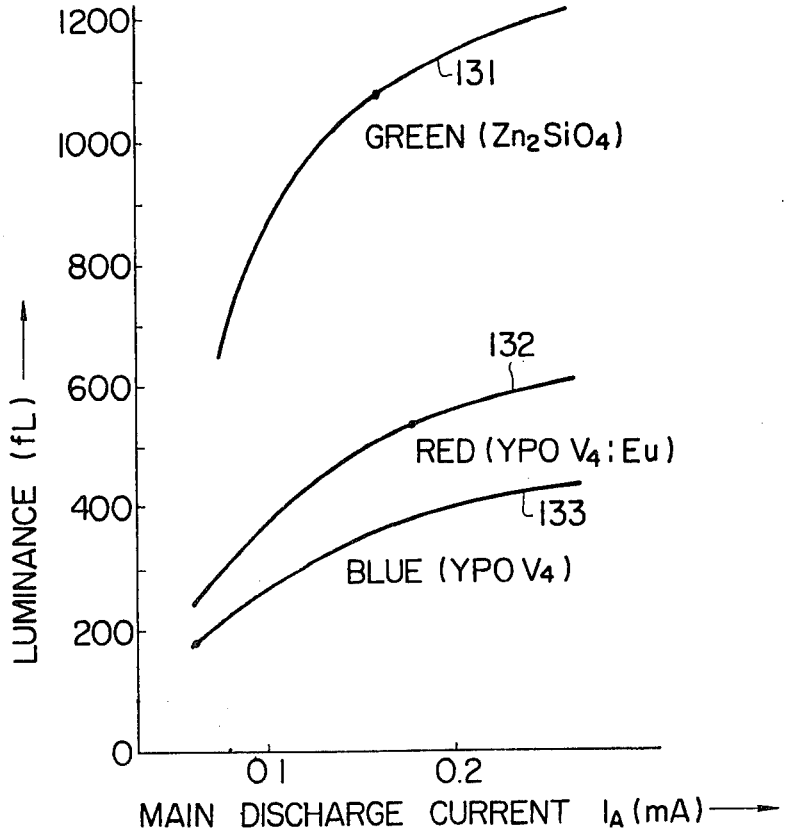
FIGS. 13A and B are diagrams showing the luminance characteristics and luminous efficiency obtained by the driving method according to the present invention.
Figure 13B:
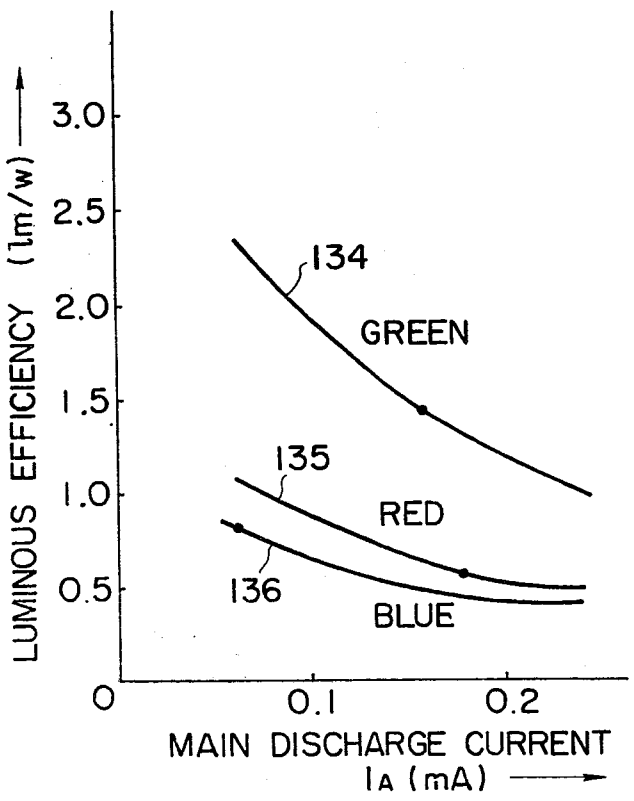

FIG. 13A and FIG. 13B respectively show the actually measured luminance characteristics and efficiency characteristics of the flat display panel according to the present invention which uses Xe gas filling the discharge space at 40 Torr.

In FIG. 13A, the main discharge current $I_A$ is represented in A along the abscissa and the luminance is represented in fL along the ordinate. Curves 131, 132 and 133 represent the luminances of the colors green, red and blue fluorescent materials deposited on the main discharge space.

In FIG. 13B, the man discharge current $I_A$ is represented in mA along the abscissa and the efficiency is represented in *l*m/w along the ordinate. Curves 134, 135 and 136 represent the efficiency of the fluorescent materials having three colors, green, red and blue, respectively.

In the case of reproducing a picture by the well known TV receiver, when a white balance is obtained from the three colors red (R), blue (B) and green (G), an average area luminance of 200 fL and an efficiency of 2*l*m/w is required. At this time, the luminance of each color required to reproduce the picture is 1080 fL for green, 540 fL for red and 180 fL for blue. However, the flat display panel of this invention easily satisfies these conditions by using a small main discharge current $I_A$ the magnitude of which is only 200 μA at most, as shown in FIG. 13A. Also, the efficiency according to the present invention is ten times the efficiency of the prior art panel as shown in FIG. 13B. Therefore, the above conditions are satisfied with the present invention.

FIG. 4 shows one example of actually measured discharge characteristics of one embodiment of the flat plasma panel according to the present invention.

In this figure, the amplitude $V_A$ of the exciting voltage of the main discharge is represented in volts along the ordinate, while the phase difference $t_{GA}$ is represented along the abscissa. The curve 41 represents the ignition voltage $V_B$ of the main discharge and the curve 42 represents the extinction voltage $V_E$. It is clear from curves 41 and 42 that the voltage of $V_B$ and $V_E$ are about 80 volts and 30 volts respectively, where the phase difference $t_{GA}$ is zero.

The voltage values and the other condition employed in the panel are enumerated by way of examples as follows:

| | |
|---|---|
| Gas filled in the main discharge gas | Ne-Ar opening gas |
| Bias voltage $E_A$ | 60 volts |
| Cathode exciting voltage $E_K$ | 300 volts |
| Grid exciting voltage $V_G$ | 100 volts |
| Width of the anode and grid exciting voltage $t_A$ and $t_G$ | 2μS |
| Period T of the exciting voltage | 5μS |

In the FIG. 4, if the operational point of the panel according to the present invention is selected at the voltage indicated by dotted line 43, it is possible to realize three states namely the addressed state, the half-selected state and the holding state which are determined by the operation mode of the main discharge generated in the discharge cell of the flat plasma panel. That is, each of the addressed state, the half-selected state and the holding state corresponds to points (*a*), (*b*) and (*c*) which exist on the dotted line 43. The erasing state corresponds to points (*d*) and (*e*) as shown in FIG. 4, which represent a state of suspension of the main discharge. Therefore, the gas-discharge cell operates as a discharge display element with an internal memory function, where the voltage $V_0$ corresponding to the point (*b*) is the discharge maintenance voltage.

As a result of controlling the quantity of electrons diffused into the main discharge space from the auxiliary discharge space by changing the potential across the anode A and grid G with a time phase difference the discharge cell of the flat display panel according to the present invention has the characteristics shown in FIG. 4, FIG. 13A and FIG. 13B.

Moreover, the discharge cell according to the present invention also shows substantially the same characteristics of FIG. 4, even when the color information is displayed using Xe gas. That is, FIG. 5 shows the change in the ignition voltage and extinction voltage.

In FIG. 5, the same items as in FIG. 4 are indicated by the same reference numerals, where the voltage values and the other condition employed in the panel are enumerated by way of example as follows:

| | |
|---|---|
| Bias voltage $E_A$ | 70 volts |
| Cathode exciting voltage $E_K$ | 300 volts |
| Values of ignition voltage $V_B$ and extinction voltage $V_E$ of the main discharge where the phase difference $t_{GA}$ is zero | 160 volts and 30 volts |
| Width $t_G$ of the grid exciting voltage | 1μS |

Next, the driving method of the discharge cell having the above-mentioned characteristics will be described.

Figure 6:
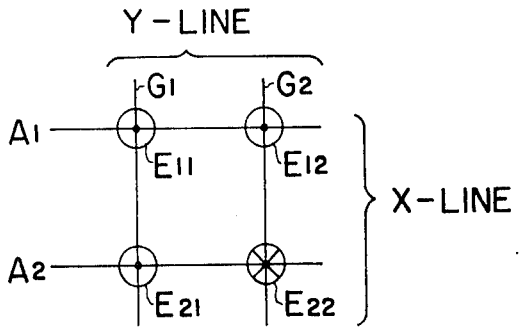
FIG. 6 is a connection diagram showing a matrix type panel to which a drive method according to the present invention is applied.

Shown in FIG. 6 is an example of the equivalent circuit of a panel having said discharge cell to which the present invention is applied, the discharge cell being filled with Ne-Ar opening gas. The figure illustrates a 2 × 2 array of discharge cells. The number of picture elements depending on the discharge cell may be two or more, and the case illustrated is used in order to facilitate the description.

The figure display cells arranged in the form of a matrix, as an example, are connected at one end to a first group of electrodes $A_1$ and $A_2$ at every row (X-line) as the anode, and are connected at the other end to a second group of electrodes $G_1$ and $G_2$ at every column (Y-line) as the grid to which the video signal is applied.

In case where only the discharge cell $E_{22}$ in FIG. 6 is addressed, it is necessary that the voltage potential between electrodes $A_2$ and $G_2$ reaches the discharge ignition voltage $V_B$. Also, it is necessary that the voltage potential between electrodes $A_2$ and $G_2$ reaches the discharge extinction voltage $V_{S1}$ in case only the discharge cell $E_{22}$ in FIG. 6 is erased.

Figure 7A:
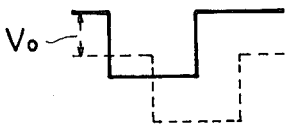
FIGS. 7A–FIG. 7F and FIG. 8A–FIG. 8F are waveform diagrams showing examples of waveforms by the driving method according to the present invention applied to the matrix panel as shown in FIG. 6.
Figure 7B:
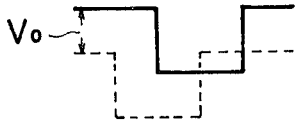
Figure 7C:
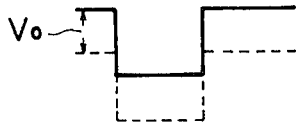
Figure 7D:
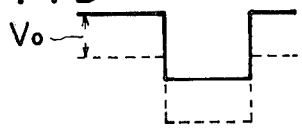
Figure 7E:
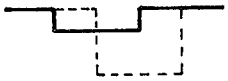
Figure 7F:
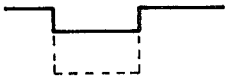

Therefore, as is clear from the FIG. 4, it is possible to address or erase the discharge cell by changing the phase difference $t_{GA}$ created between the exciting voltages shown in FIG. 3 for application to the respective electrodes of the X-lines and Y-lines. That is, the driving method according to the present invention applying voltages as illustrated in FIG. 7A - FIG. 7F is fundamental. With this method, the voltage impressed on a holding discharge cell $E_{11}$ in FIG. 6 is shown in FIG. 7A and the exciting voltages applied to the electrodes $A_1$ and $G_1$ are respectively indicated by the solid line and the dotted line. The exciting voltage applied to the address discharge cell $E_{22}$ in FIG. 6 is shown in FIG. 7B and the voltages applied to electrodes $A_2$ and $G_2$ are indicated by the solid line and the dotted line respectively. The exciting voltage applied to the half-select discharge cell $E_{12}$ in FIG. 6 is shown in FIG. 7C and the voltages applied to electrodes $A_1$ and $G_2$ are indicated by solid line and dotted line respectively. The exciting voltages applied to the half-select discharge cell $E_{21}$ in FIG. 6 is shown in FIG. 7D and the voltages applied to electrodes $A_2$ and $G_1$ are indicated by a solid line and a dotted line, respectively. The voltage applied to the erase discharge cell is shown in FIGS. 7E and 7F and the exciting voltages applied to the X-line and the Y-line are indicated by a solid line and dotted line respectively.

In short, in the holding state, as is clear from point (*c*) shown in FIG. 4, the exciting voltage having the delay time $t_1$ relative to the exciting voltage applied to the Y-line is applied to the X-line. On the other hand, in the address state, as is clear from said point (*a*) in FIG. 4, the exciting voltage having a lead time $t_1$ relative to the exciting voltage applied to the Y-line is applied to the X-line. However, the delay time $t_1$ is not always equal to the lead time $t_1$. Moreover, for the erase state, the voltage applied to the X-line, including the discharge cell to be erased, is set below the amplitude of the discharge extinction voltage $V_E$. In this case, as is clear from points (*c*) and (*e*) shown in FIG. 4, there are two phase differences.

FIGS. 8A to 8F show another example of the waveform used in the display using the discharge cell filled with Xe gas which indicates the characteristics shown in FIG. 5. The waveforms in the figures are of the displaying the pattern in FIG. 6.

Figure 8A:
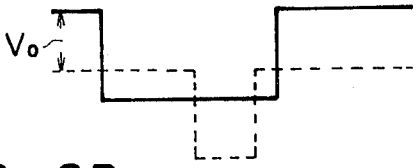
Figure 8B:
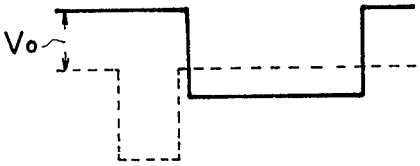
Figure 8C:
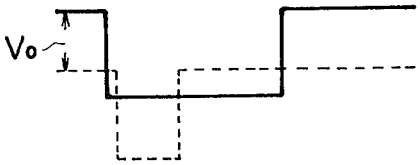
Figure 8D:
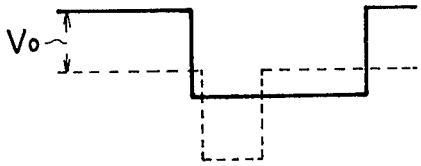
Figure 8E:
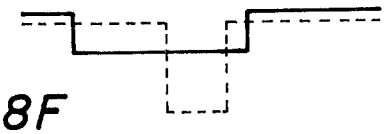
Figure 8F:
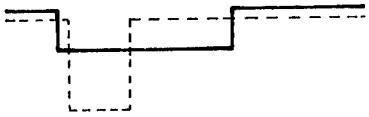

In FIGS. 8A to 8F, the exciting voltages applied to the X-line and the Y-line are indicated by the solid line and the dotted line respectively. FIGS. 8A, 8B, 8C and 8D show the holding state of discharge cell $E_{11}$, the address state of the discharge cell $E_{22}$ the half-select state of discharge cell $E_{12}$ and the half-select state of discharge cell $E_{21}$, respectively. FIGS. 8E and 9F show the erase state of a discharge cell.

Figure 9:
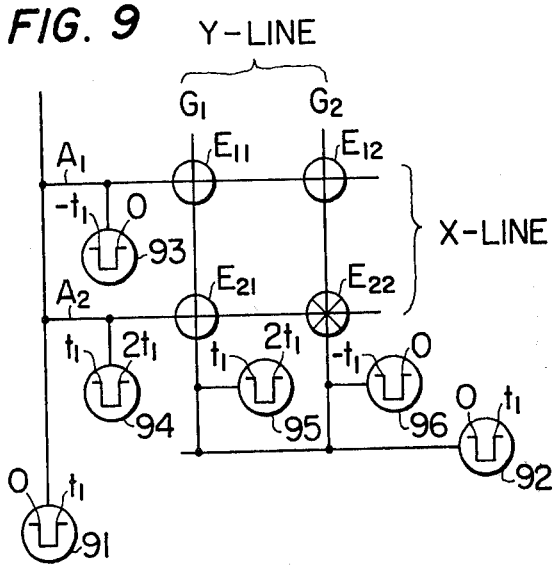
FIG. 9 is another connection diagram showing a matrix type panel to which the driving method according to the present invention is applied.
Figure 10A:
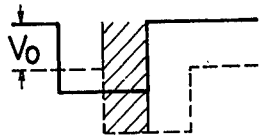
FIG. 10 is a waveform diagram showing another example of the waveforms by the driving method according to the present invention applied to the matrix panel as shown in FIG. 9.
Figure 10B:
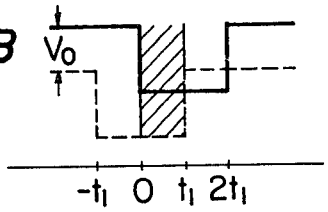

FIG. 9 shows another example of the driving method according to the present invention which is applicable to an equivalent circuit shown in FIG. 6. In FIG. 9, voltages generated from exciting voltage sources 91 and 92 are respectively applied to the X-line and Y-line periodically at predetermined periods whose amplitudes are respectively $V_A$ and $V_G$ and the pulse width of both is $t_1$ and the voltage generated from exciting voltage sources 93 and 94 are respectively applied to electrode $A_1$ and $A_2$ in addition to the voltage from source 91, and voltages generated from exciting voltage sources 95 and 96 are respectively applied to electrode $G_1$ and $G_2$ in addition to the voltage from source 92. According to this driving method, the exciting voltage shown in FIGS. 10A and 10B are obtained as a result. That is, in FIGS. 10A and 10B, the voltages indicated by the solid line are respectively applied to electrode $A_1$ and $A_2$ and voltages indicated by the dotted line are respectively applied to electrode $G_1$ and $G_2$, voltages indicated by the shaded portion from 0 to time $t_1$ correspond to the voltage from sources 91 and 92, voltages from $-t_1$ to 0 in time correspond to the voltage from sources 93 and 96 and the voltages from $t_1$ to $2t_1$ correspond to voltage from sources 94 and 95. Therefore, if the voltages indicated by the shaded portion are periodically applied to the X-line and the Y-line shown in FIG. 9, the other exciting voltages generated from the sources 93–96 are superimposed on the voltages as the need arises, so that the same exciting voltages as the voltages shown in FIGS. 7A–7F are obtained. Thus, a driving method according to the change of phase of the exciting voltages therebetween is realized. In FIG. 10A in order to effect the holding-state of the discharge cell $E_{11}$ in FIG. 9 and the exciting voltage superimposed on the X-line at the time $-t_1$ is as indicated by the solid line whose amplitude is $V_0$ and pulse width is $t_1$ and the exciting voltage superposed on the Y-line at the time $t_1$ is as indicated by the dotted line, whose amplitude is $V_G$ and pulse width is $t_1$.

In FIG. 10B, in order to effect the address state of the discharge cell $E_{22}$ in FIG. 9, the exciting voltage superposed on the X-line at the time $t_1$ is as indicated by the solid line and has an amplitude $V_A$ and a pulse width of $t_1$ and the exciting voltage superposed on the Y-line at the time $-t_1$ is as indicated by the dotted line, and has an amplitude of $V_G$ and a pulse width of $t_1$. Of course, the driving method of the present invention is in no way limited to the states of discharge cell $E_{11}$ and $E_{22}$ and is applicable to any discharge cell state.

Figure 14:
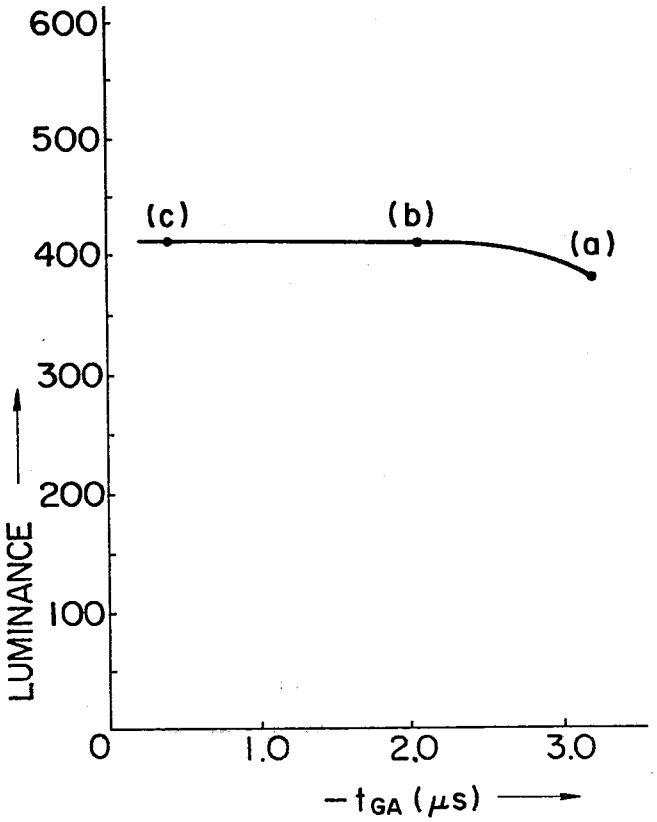
FIG. 14 is an explanatory diagram which illustrates the change of luminance characteristics relative to the phase difference of the applied voltages of the anode and the grid.

FIG. 14 shows the change of luminance during the periods of address, selected state, half selected state and holding state, which are respectively indicated by points (*a*), (*b*) and (*c*). In this figure, luminance is represented on an arbitrary scale as the ordinate, while the phase difference $t_{GA}$ is represented as the abscissa.

As is clear from FIG. 14, the change in the luminance during holding states in the prior-art display panel is eliminated and a high quality display picture is obtained.

As described above, the discharge cell with an internal memory function according to the present invention is realized by changing the phase difference between the exciting voltage applied to the X-line and the exciting voltage applied to the Y-line. However, the present invention is in no way limited to such a change of phase difference and is attainable by the following method, that is (1) a method of using the combination of pulse width $t_G$ and $t_A$ shown in FIG. 3, (2) a method of using the combination of phase difference $t_{GA}$ and the amplitude of the anode bias voltage $E_A$; (3) a method of using the combination of the amplitude of the anode bias voltage $E_A$ and the amplitude of the grid exciting voltage $V_G$ (4) a method of using the combination of the amplitude of the anode bias voltage $E_A$ and pulse width $t_A$ or $t_G$ of the exciting voltage.

Figure 11:
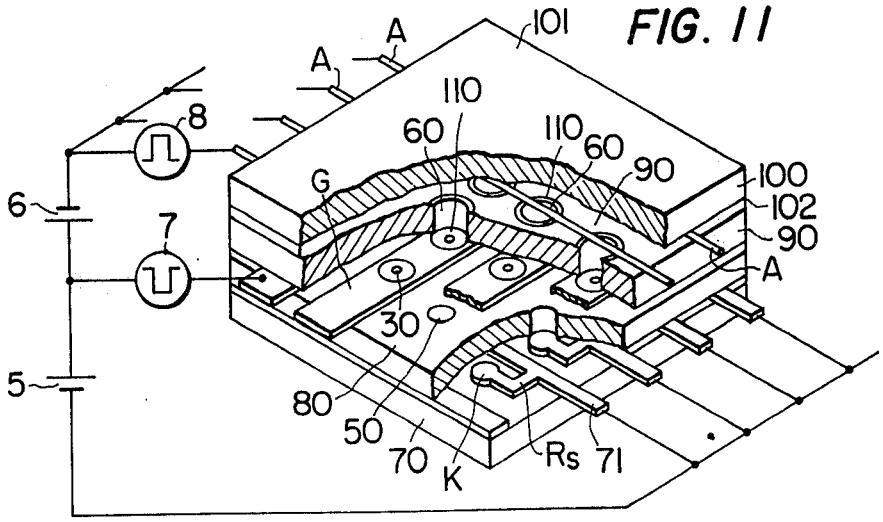
FIG. 11 is a perspective view, partly in section, of a display panel embodying the present invention.

An embodiment of the concrete structure of the flat discharge panel of a electron-acceleration type with an internal memory according to this invention is shown in FIG. 11, in which like parts are designated by like reference numerals as given in FIG. 2.

FIG. 11 shows the flat discharge panel in which a plurality of discharge cells 1 shown in FIG. 2 are formed of the matrix type.

Referring to the figure, an insulating substrate 70 is provided with a plurality of common cathode rails 71 at predetermined intervals and a pitch of about 0.4–1 mm. The common cathode rails 71 are formed by the print and sinter method on the substrate 70 of glass or ceramic. The cathodes K are also provided with rows and columns on the substrate 70 corresponding to each discharge cell. The resistors $R_S$ to control the auxiliary discharge current, are connected between the common cathode rails 71 and the cathodes K, the resistors $R_S$ being formed by the print and sinter method X. On the substrate 70, the first insulating material 80 having a number of holes 50 to serve as auxiliary discharge spaces is disposed. Each of the holes 50 is disposed with rows and columns so as to correspond to each cathode K and is formed in cylindrically or polygonal form. Grid electrodes G each having one or a number of priming apertures 30, are provided on the holes 50 in the first insulating material 80 so as to orthogonally intersect the common cathode lines 71. In this case, each of the apertures 30 is provided in the positions corresponding to the holes 50. The grid electrodes G each of which is about 50–500 μ thick may be made of nickel, alloys of nickel-iron, etc. The resistor $R_S$ the value of which is about 0.1–3MΩ may be made of DU PONT No 1271 (trademark). Although in the above description, the angle of intersection between the grid G and the common cathode line 71 is 90°, it is a matter of course that the grid G may intersect the common cathode line 71 at an arbitrary angle, for example at an angle of 60°.

Moreover, the second insulating material 90 having a number of holes 60 to serve as the main discharge space is disposed on the grid electrode G. Each of holes 60 is disposed with rows and columns corresponding to each priming aperture 30 and is formed by circular cylindrically or polygonally. On the holes 60 of the second insulating material 90, a plurality of small diameter wires used as anode electrodes A are arranged in parallel. The small diameter wires are covered with transparent insulating material 100 which has a top surface 101 and a bottom surface 102. It should be noted that the aforesaid anode electrodes A need not necessarily be in the form of wires but can be in stripe form arranged in parallel. In this case, the anode electrodes A of the stripe form having apertures are formed by the so-called printed method on the bottom surface 102 of the transparent material 100 and are arranged in parallel with the common cathode rails 71. In addition, in case transparent anode electrodes A are made of tin oxide or indium oxide, the aforesaid apertures in anode electrode A are not required. The cathode electrode K and anode electrode A may be made of DU PONT No. 8451 (trademark).

For a color display, a phosphor material 110 is applied to the inner peripheral walls of the holes 60 or the apertures of said the electrode which face the main discharge spaces.

Gas used in the discharge is introduced into the aforesaid discharge spaces. Gases which may be used for discharge gas include gases such as rare gas, mercury vapor, cerium vapor and the like, i.e. mixtures such as Xe, He-Xe, Ne-Xe, Ar-Hg, Ne-Ar, Ar-Cs, etc. The pressure range of these gases to be sealing by filled in the discharge space is from 0.1 to 500 Torr.

In addition, to protect them from electron bombardment resistor $R_S$ and common cathode rails 71 are covered with insulating material.

Figure 12:
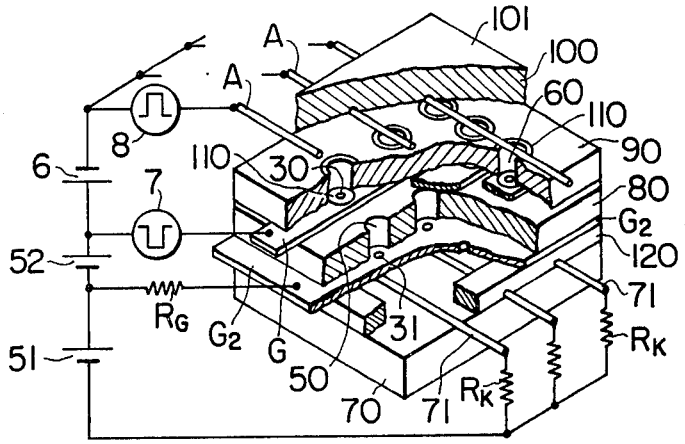
FIGS. 12 and 15 are perspective views, partly in section, of another display panel embodying the present invention.

FIG. 12 depicts another embodiment which has two grid electrodes in place of resistor $R_S$ connected to each discharge cell. This embodiment is a perspective view, partly in section, of a display panel embodying the invention, in which like parts are designated by like reference numerals in common with those given in FIG. 11.

In FIG. 12, the common cathode rails 71 are used for the emission of electrons as a cathode, $G_2$ indicates the second grid electrode having apertures 31 which are provided with rows and columns in the second grid electrode $G_2$ and the numeral 120 denotes a spacer inserted between the second grid electrode $G_2$ and substrate 70. Each of the apertures 31 is provided in the position corresponding to each of the holes 50 in the first insulating material 80. $R_G$ and $R_K$ are resistors connected to the second grid $G_2$ and common cathode rails 71, respectively.

In such a construction, when the DC voltage from voltage source 51 is applied between the second grid electrode $G_2$ and common cathode rails 71 through the resistor $R_G$ (which is not always necessary) and resistors $R_K$, the second auxiliary discharge is increased between the second grid electrode $G_2$ and common cathode rails 71. The electrons generated from the second auxiliary discharge pass through the apertures 31 and diffuse into the holes 50. Next, when the DC voltage from the voltage source 52 applied between the grid electrode G and second grid electrode $G_2$ through the resistor $R_G$, the first auxiliary discharge is increased between the grid electrode G and the second grid electrode $G_2$. That is, a first auxiliary discharge is produced in said holes 50. Accordingly, the aforesaid auxiliary discharge generated in the embodiment of FIG. 11 is produced by the first auxiliary discharge and second auxiliary discharge.

The embodiment shown in FIG. 12 gives rise to the features summarized below.

1. The resistor $R_S$ to stabilize the auxiliary discharge is not necessary for every discharge cell. In the present embodiment the resistor $R_K$ is connected to the common cathode lines.

2. A high efficiency flat plasma display apparatus is attained because it is positive to produce an electrostatic double layer in the auxiliary discharge in addition to the electrostatic double layer produced in the main discharge.

3. In the embodiment shown in FIG. 12, a first auxiliary discharge is maintained by a voltage which is lower than the voltage used to maintain the auxiliary discharge generated in the embodiment shown in FIG. 11. Therefore, the DC voltage generated from source 6 and the exciting voltages generated from sources 8 and 7 are lower than the voltage utilized in the prior-art flat plasma display. For this reason, it is possible to form the driving circuit as an integrated circuit, thus making it possible to realize a compact display apparatus.

In addition, in the present embodiment shown in FIG. 12, it is possible to create a barrier on the substrate 70 to prevent mutual interference of auxliary discharges. Moreover, it is possible to arrange the grid electrode G, the second grid electrode $G_2$ and common cathode lines 71 in matrix form to prevent mutual interference of auxliary discharge. However, in this case, the second grid electrode $G_2$ is made up of a plurality of metal stripes disposed on the bottom surface of the first insulating material 80. It is not always necessary that the number of the common lines 71 and the second grid electrode $G_2$ be respectively identical with the number of the anodes A.

Figure 15:
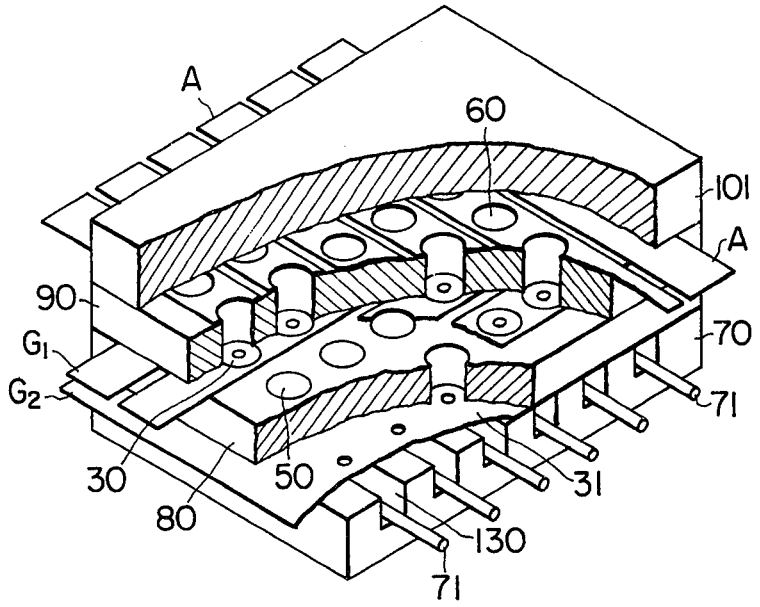

FIG. 15 shows another embodiment of the present invention used to prevent mutual interference of auxiliary discharges, wherein the same components as in FIG. 12 are indicated by the same reference numerals. Referring to the figure, the insulating substrate 70 is provided with slots 130 to form auxiliary discharge spaces. Each of the common cathode rails 71 is disposed in the slots 130. Therefore, the auxiliary discharge is formed in slots 130, so that there is no mutual interference of the auxiliary discharge.

As is apparent from the foregoing description, according to the flat plasma display panel of the present invention, the electrons generated from the auxliary discharge are controlled by the pulse voltage applied to the anode electrode and the grid electrode. The pulse voltage represents the information to be displayed for example, a television picture, which thereby makes it possible to keep the internal memory function of the flat plasma panel and makes it possible to produce a positive column discharge in place of a glow discharge. For this reason, the present invention not only provides a high speed drive but also operates with a high efficiency and high luminance for the flat plasma display panel.

We claim:

1. In a flat discharge display panel having a plurality of gas discharge cells disposed in a matrix, the improvement wherein each of said cells comprises a cathode electrode;

a grid electrode having at least one aperture therethrough aligned in position with the projection of said cathode electrode upon said grid electrode;

an anode electrode disposed apart from the side of said grid electrode opposite that facing said cathode electrode;

a main discharge space provided between said grid electrode and said anode electrode at a position corresponding to said at least one aperture through said grid electrode;

an auxiliary discharge space provided between said grid electrode and said cathode electrode;

a resistor, for controlling and stabilizing an auxiliary discharge generated in said auxiliary discharge space, coupled between said cathode electrode and said grid electrode;

gas sealed within and filling the main discharge space, the auxiliary discharge space and the aperture through said grid electrode, and means for applying pulse signals to said grid and anode electrodes;

whereby electrons are generated and pass through said aperture in said grid electrode and are controlled and accelerated by said pulse signals enabling a main discharge to retain an internal memory function within said cell.

2. A flat display panel comprising:

a plurality of common cathode lines disposed in parallel on top of a first insulation sheet;

a plurality of rows and columns of cathode electrodes provided on said first insulation sheet;

a plurality of resistors disposed on said first insulation sheet, each respective resistor connecting a respective cathode electrode to a common cathode line;

a second insulation sheet defining auxiliary discharge spaces above said cathode electrodes;

a plurality of grid electrodes in sheet form disposed on top of said second insulation sheet at a predetermined angle relative to said common cathode lines, and having apertures therethrough at positions corresponding to said auxiliary discharge spaces;

a third insulation sheet having spaces therein above said apertures, a main discharge being carried out in the spaces in said third insulation sheet;

a plurality of anode electrodes disposed on top of said third insulation sheet in parallel with said grid electrodes;

a transparent insulation sheet disposed on top of said anode electrodes;

gas sealed within and filling said main discharge spaces, auxiliary discharge spaces, and apertures provided in said grid electrodes; and means for applying pulse signals to said grid and anode electrodes so that said main discharge maintains an internal memory function due to electrons, which pass through said apertures, controlled and accelerated by a pulse signal applied to said grid and anode electrodes.

3. A flat discharge panel according to claim 2, wherein fluorescent material is applied to at least part of portions defining the main discharge spaces.

4. A flat discharge panel according to claim 2, wherein said anode electrodes are transparent electrodes.

5. A flat discharge panel according to claim 2, wherein said anode electrodes are wires of small diameter.

6. A flat discharge panel according to claim 2, wherein said anode electrodes are in the form of stripes, having apertures at positions corresponding to said main discharge spaces.

7. A flat discharge panel comprising:

a plurality of cathodes disposed in parallel on top of a first insulation sheet;

a first grid electrode disposed at a predetermined distance from said cathodes and having rows and columns of apertures corresponding to respective positions which project upon said cathodes, a first auxiliary discharge being carried out in the spaces between said cathodes and said first grid electrode;

a second insulation sheet disposed on said first grid electrode, said second insulation sheet having spaces at positions corresponding to said apertures, a second auxiliary discharge being carried out in said spaces;

a plurality of parallel second grid electrodes provided on said second insulation sheet so as to intersect said cathodes, each of said second grid electrodes having apertures at positions corresponding to said spaces in the second insulation sheet;

a third insulation sheet having spaces therein above the apertures in the second grid electrodes, a main discharge being carried out in the spaces in said third insulation sheet;

a plurality of anode electrodes disposed on top of said third insulation sheet in parallel with said cathodes;

a transparent insulation sheet disposed on top of said anode electrodes; and gas sealed within and filling said main discharge spaces, and said auxiliary discharge spaces.

8. A flat discharge panel according to claim 7, wherein each of said cathodes is disposed in respective slots formed in said first insulation sheet.

9. A flat discharge panel according to claim 7, wherein said second grid electrodes are in the form of stripes, having apertures at positions corresponding to the apertures in said first grid electrode.

10. A flat discharge panel according to claim 7, wherein fluorescent material is applied to at least part of the portion defining the main discharge spaces.

11. A flat discharge panel according to claim 7, wherein said anode electrodes are transparent electrodes.

12. A flat discharge panel according to claim 7, wherein said anode electrodes are wires of small diameter.

13. A method of driving a flat discharge panel, said panel including a plurality of parallel X-axis electrodes as anode electrodes, a plurality of parallel Y-axis electrodes disposed perpendicular to said X-axis electrodes as grid electrodes, a plurality of parallel cathode electrodes disposed in parallel with said anode electrodes, main discharge spaces provided at the points where X-axis electrodes cross said Y-axis electrodes, auxiliary discharge spaces provided at the points where Y-axis electrodes cross said cathode electrodes, combined spaces provided between said main discharge spaces and said auxiliary discharge spaces to combine said main discharge spaces with said auxiliary discharge spaces, a gas which is hermetically contained in said main and auxiliary discharge spaces, respective resistors connected between each grid electrode and each cathode electrode, said method consisting of the steps of a. applying a first voltage pulse to said X-axis electrodes, b. applying a second voltage pulse, corresponding to information to be displayed, to respective ones of said Y-axis of electrodes, and c. controlling the phase relationship between said first voltage pulse and said second voltage pulse so as to impart a prescribed phase difference therebetween.

14. A flat discharge panel comprising:

a plurality of cathodes disposed in parallel on top of a first insulation sheet;

a first grid electrode disposed at a predetermined distance from said cathodes and having rows and columns of apertures corresponding to respective positions which project upon said cathodes, a first auxiliary discharge being carried out in the spaces between said cathodes and said first grid electrode;

a second insulation sheet disposed on said first grid electrode, said second insulation sheet having spaces at positions corresponding to said apertures, a second auxiliary discharge being carried out in said spaces;

a plurality of parallel second grid electrodes provided on said second insulation sheet so as to intersect said cathodes, each of said second grid electrodes having apertures at positions corresponding to said spaces in the second insulation sheet;

a third insulation sheet having spaces therein above the apertures in the second grid electrodes, a main discharge being carried out in the spaces in said third insulation sheet;

a plurality of anode electrodes disposed on top of said third insulation sheet in parallel with said cathodes;

a transparent insulation sheet disposed on top of said anode electrodes;

gas sealed within and filling said main discharge spaces, and said auxiliary discharge spaces; and means for applying a prescribed D.C. bias potential between said first grid electrode and said plurality of cathodes, including a first D.C. voltage source coupled to said first grid electrode and a plurality of respective resistors connected between said first D.C. voltage source and respective ones of said plurality of cathodes.

15. A flat discharge panel according to claim 14, wherein each of said cathodes is disposed in respective slots formed in said first insulation sheet.

16. A flat discharge panel according to claim 14, further including means for applying prescribed pulse signals to each of said anode and second grid electrodes.

17. A flat discharge panel according to claim 16, further comprising a second D.C. voltage source coupled between said first and second grid electrodes.

18. A flat discharge panel according to claim 17, further comprising a third D.C. voltage source coupled between said anode electrodes and said second grid electrodes.

* * * * *